United States Patent [19]

Seitz

[11] 3,943,340

[45] Mar. 9, 1976

[54] COMPUTER AUXILIARY GEAR BOX

[75] Inventor: Richard Seitz, Rockville, Conn.

[73] Assignee: Veeder Industries, Inc., Hartford, Conn.

[22] Filed: Sept. 6, 1974

[21] Appl. No.: 503,614

[52] U.S. Cl. ..... 235/94 R; 235/61 L
[51] Int. Cl.[2] ..... G06C 15/42; B67D 5/22
[58] Field of Search .... 235/94 R, 94 A, 61 L, 61 M

[56] References Cited

UNITED STATES PATENTS 3,863,839 2/1975 Batson ..... 235/94 R

*Primary Examiner*—Stephen J. Tomsky
*Attorney, Agent, or Firm*—Prutzman, Hayes, Kalb & Chilton

[57] ABSTRACT

Converter for a fuel pump computer having a register driven by a variator normally connected to be driven by a meter wherein the converter is attachable to the variator for driving it by a variator drive gear in the converter which has a meter driven rotary input and change speed gearing for expanding the price range of the computer. In a first setting, the rotary input is connected to the variator drive gear in 1:1 drive ratio. In a second setting, the rotary input is connected to the variator drive gear via the change speed gearing to provide a selected drive ratio for a different unit volume of fuel delivered. The settings of the converter are changed by an interlock providing an irreversible gear ratio changeover.

12 Claims, 5 Drawing Figures

COMPUTER AUXILIARY GEAR BOX

SUMMARY OF THE INVENTION

This invention relates to mechanical fuel pump computers of a type employed in gasoline dispensing apparatus for establishing and posting a unit volume price for a gallon of fuel, registering the volume of fuel delivered in gallons and computing and registering the cost of fuel delivered in dollars and cents. A conventional mechanical register of a type used in such computers is shown and described in U.S. Pat. No. 2,814,444 of Harvey N. Bliss dated Nov. 26, 1957, entitled "Register" and assigned to the assignee of this invention. Such computers also employ mechanical variators of a type shown and described in U.S. Pat. No. 3,413,867 of Richard B. Hamlin dated Dec. 3, 1968, entitled "Variator" and assigned to the assignee of this invention. More specifically, this invention particularly concerns a converter for such mechanical fuel pump computers such as that converter shown and described in U.S. patent application Ser. No. 442,476 of Brad Batson filed Feb. 14, 1974, now U.S. Pat. No. 3,863,839, entitled "Fuel Pump Computer Converter to Quarts/Liters Pricing and Cost Computation" and assigned to the assignee of this invention. The converter of the referenced application provides for selectively establishing and posting a unit volume price for a quart or liter of fuel, registering the volume of fuel deliviered in quarts or liters, as the case may be, and registering cost of fuel delivered in dollars and cents in accordance with volume of fuel delivered and the posted unit volume price.

A conventional mechanical fuel pump computer incorporates a mechanical register having a pair of counters on each of two opposite faces of the register for registering, on each of the opposite faces, the cost of fuel delivered in dollars and cents and the volume of fuel delivered in gallons. Such a register is shown in referenced U.S. Pat. No. 2,814,444. The fuel pump computer also incorporates a mechanical variator of the type disclosed in referenced U.S. Pat. No. 3,413,867 for establishing and posting the unit volume price for a gallon of fuel. The variator is connected to be mechanically driven by a conventional gasoline meter so that the variator center shaft is rotated four revolutions for each gallon of fuel delivered. The variator is also connected for driving the volume and cost counters of the register for registering the volume amount of fuel delivered in gallons and the cost amount of fuel delivered in dollars and cents in accordance with the volume amount of fuel delivered in gallons and the gallon unit volume price established by the variator setting.

Because of the increasing cost of gasoline, the price of a gallon of gasoline now frequently exceeds the maximum range of 49 and 9/10 cents of conventional limited range variators in the field. In the future, the price of a gallon of gasoline may exceed the maximum range of 99 and 9/10 cents of conventional greater range variators in the field.

Also, consideration is being given to converting to the metric measuring system. In this event, the present gallons measure used in fuel pump computers may, by requirement or by choice, be changed to a liters measure. Because of the foregoing considerations, it may become desirable, essential or even mandatory to convert existing mechanical fuel pump computers from the present gallon unit volume price setting and gallon volume registration of fuel delivered to provide a quart or liter unit volume price setting and a volume registration in quarts or liters of fuel delivered.

Therefore, a principal advantage of this invention is in the provision of a converter for selectively converting conventional mechanical fuel pump computers for establishing and posting a unit volume price in quarts or liters, for registering the volume amount of the fuel delivered in quarts/liters and registering the cost amount of the fuel delivered in dollars and cents in accordance with the volume amount delivered in quarts/liters and a quart/liter unit volume price established by the setting of the variator.

Another advantage of this invention is the provision of a new and improved converter of the type described which permits field conversion of existing conventional computers with minimum inconvenience and down time.

A further advantage of this invention is the provision of a new and improved selectively operable converter for a mechanical gasoline pump computer which converter is settable alternatively for establishing either a gallon unit volume price and registering the fuel delivered in gallon amounts in the conventional manner, or a unit volume price in either quarts/liters and for registering the volume amount of fuel delivered in quarts/liters.

Still another advantage of this invention is the provision of a new and improved selectively operable converter for a gasoline pump computer which may be selectively set from a gallon setting to a quart/liter setting, or from a quart setting, e.g., to a liter setting when desired, and which once set is irreversible and cannot be reset to its previous setting after changeover to a different computation is made.

Other objects will be in part obvious and in part pointed out more in detail hereinafter.

A better understanding of this invention will be obtained from the following detailed description and the accompanying drawings of illustrative applications of this invention.

DESCRIPTION OF PREFERRED EMBODIMENTS

Figure 1:
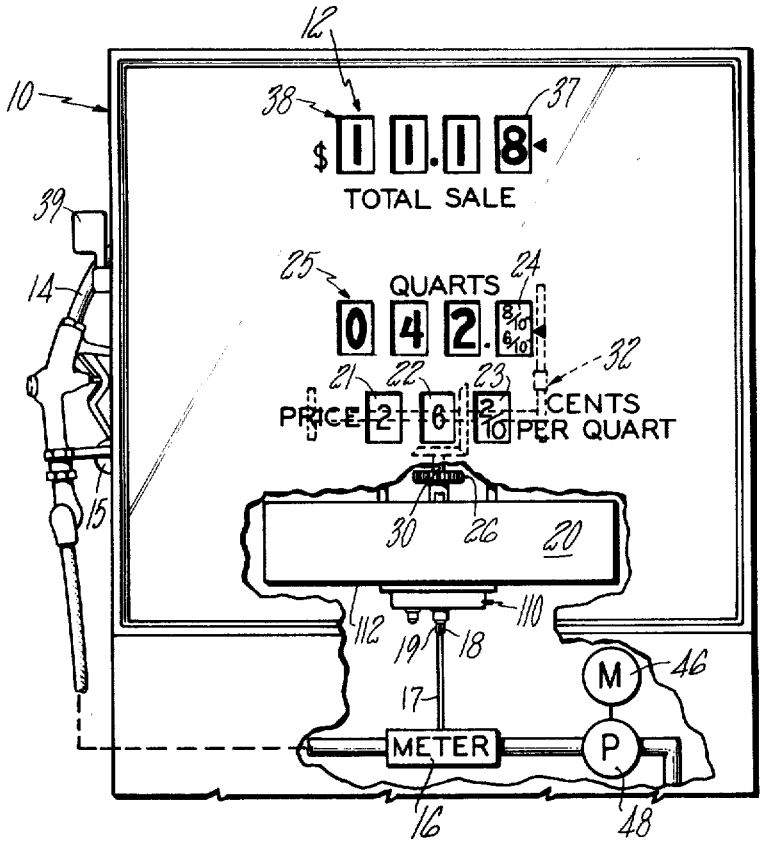
FIG. 1 is a partial front elevational view, partly broken away, of a fuel pump having a mechanical computer modified in accordance with this invention.

Referring now to the drawings in detail, a gasoline delivery pump 10 employing a mechanical computer 12 modified in accordance with this invention is shown having a nozzle 14 for delivering fuel and a suitable nozzle storage receptacle 15 for storing the nozzle 14 between deliveries. A meter 16 is conventionally provided in the fuel delivery conduit and has a rotary output shaft 17 which rotates at a speed proportional to the volume amount of fuel delivered. The meter shaft 17 is suitably connected to a lower female coupling 18 of a rotary input shaft 19 of a modified variator 20 for rotating the variator input shaft 19 at a rate of four revolutions per gallon of fuel dispensed.

Except as modified as hereinafter described, the variator 20 may be of the type described in the aforementioned U.S. Pat. No. 3,413,867 and comprises three settable range arms (not shown) of ascending order of significance which can be individually manually set into engagement with selected gear steps of a cone gear (not shown) to collectively establish the desired unit volume price of fuel within a three place price range as fully shown and described in U.S. Pat. No. 3,413,867, the subject matter of which is incorporated herein by reference. The variator 20 also comprises three price posting wheels 21, 22 and 23, corresponding to the three range arms, which are mechanically connected to the range arms to automatically post the unit volume price established by the settings of the range arms.

The variator 20 has a center shaft 30 driven by the variator input shaft 19 (as hereinafter described) and which extends through the variator 20 and is connected by a suitable mechanical drive such as at 32 for driving the lowest order counter wheels (such as the one shown at 24) of a pair of register volume counters such as at 25 for registering the volume amount of fuel dispensed.

A rotary output gear 26 of the variator is rotatably mounted on the variator center shaft 30 and is driven by the meter 16 via the variator cone gear and variator range arms in accordance with the established unit volume price. The output gear 26 is mechanically connected somewhat like the variator shaft 30 for driving the lowest order counter wheels (such as at the one shown at 37) of a pair of register cost counters such as at 38 for registering the cost amount of fuel dispensed in accordance with the unit volume price established by the variator 20.

The resettable register volume and cost counters 25 and 38 are of a type fully shown and described in the aforementioned U.S. Pat. No. 2,814,444, the subject matter of which is incorporated herein by reference. The counters of the register are operable by a control handle 39 positioned adjacent the nozzle storage receptacle 15 such that the handle 39 has to be rotated to its vertical or off position to permit the nozzle 14 to be placed in its storage receptacle at the completion of a fuel delivery. The nozzle 14 has to be removed from its storage receptacle 15 to permit the handle 39 to be rotated to its horizontal or on position. Rotation of the handle 39 to its vertical or off position provides for disengaging all number wheels for conditioning the register counters to be reset. Rotation of handle 39 to its horizontal or on position provides for sequentially resetting all number wheels of the volume and cost counters 25 and 38 to zero and then re-engaging all wheels for reconditioning the register for registering the cost and volume of the next fuel delivery. The register is also connected in a known manner as described in U.S. Pat. 2,814,444 to provide for de-energizing a motor 46 for a pump 48 when the handle 39 is turned to its off position, and for re-energizing motor 46 after the volume and cost counters 25, 38 of the register have been reset and the register is conditioned for recording the next delivery.

As more fully described in the aforementioned U.S. Pat. No. 2,814,444, the register includes the previously mentioned pair of cost and volume counters 25 and 38 on each of two opposed sides of the register, only one pair of cost and volume counters being shown in the drawings. The lowest order counter wheel of each cost counter 38 is mechanically connected to be driven by the meter 16 via the variator 20 for registering the cost of each fuel delivery. The lowest order counter wheel of each volume counter 25 is mechanically connected to be driven by the meter 16 via the variator 20 for registering the volume of each fuel delivery.

As described, the conventional mechanical computer is installed to establish and post the unit volume price of a gallon of fuel with the variator 20, to register the volume amount of fuel delivered in gallons and to compute the cost amount of fuel delivered in accordance with the number of gallons delivered and the gallon unit volume price established by the variator setting.

A conventional fuel pump computer may be modified from a gallons measure to register the volume amount of fuel delivered in quarts and to compute the fuel cost in accordance with the number of quarts delivered. Such a change may be effected without changing the drive connections between the counters 25, 38 and the meter 16, other than the gear ratios. The variator 20 may be set in a known manner at one-fourth the price of a gallon of fuel to provide a quart unit volume price, and the volume and cost counters 25 and 38 of the pump register may be modified and their drive ratios may be increased and reduced respectively by a factor of four to register the total volume and cost of fuel delivered based on the posted quart unit volume price. Such a modification may be effected by replacing the lowest order volume and cost counter wheels with substitute wheels having forty graduations instead of the conventional ten, and a modified combination locking ring and transfer gear is provided in the counters 25 and 38 for indexing the next higher order counter wheel in response to rotation of the lowest order wheel of each counter 25, 38. Such modification of a conventional computer is fully shown and described in the above mentioned U.S. Pat. application Ser. No. 442,476, the subject matter of which is incorporated herein by reference.

Once a computer has been converted as described above, the indicia for the counters is accordingly modified. The computer may then also be readily converted from a quart unit volume price to a liter unit volume price.

Figure 3:
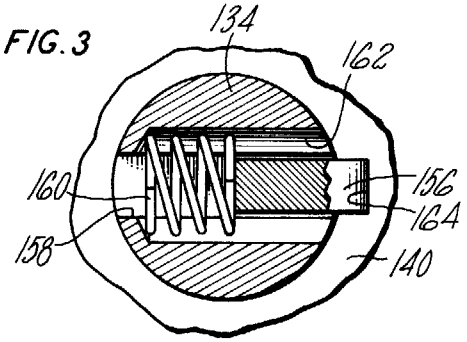
FIG. 3 is an enlarged cross sectional view, partly broken away, taken generally along line 3—3 of FIG. 2.
Figure 2:
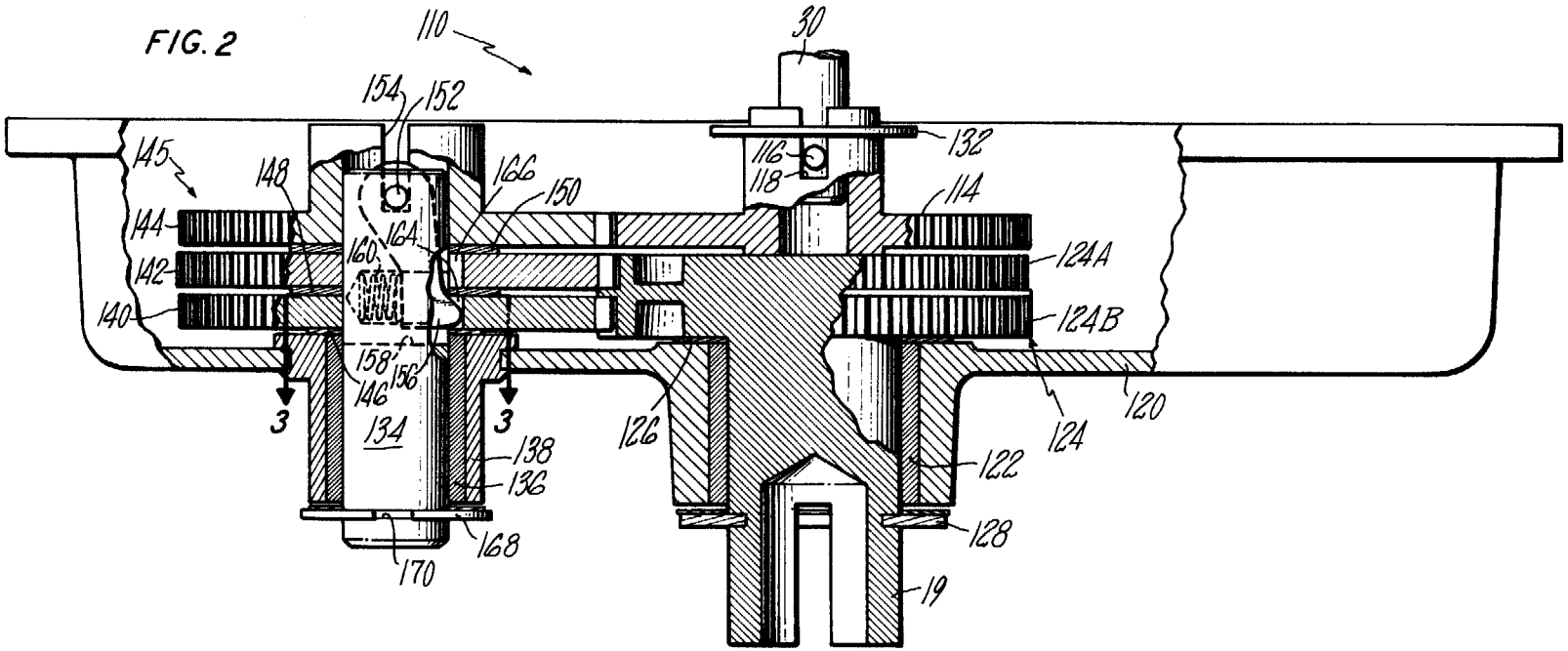
FIG. 2 is an enlarged elevational view, partly broken away and partly in section, of an auxiliary gear box of a modified mechanical computer.

A unit for readily effecting such conversion is provided in accordance with this invention and one embodiment of such a unit is illustrated in FIGS. 2 and 3. The variator 20 is modified to incorporate a selectively settable input gear box or converter 110 on an underside of a conventional base 112 of variator 20. Input gear box 110 could be installed with the use of conventional fasteners, not shown, on the underside of the base 112 when variator 20 is originally installed in the pump. If desired, gear box 110 also can be later installed on an existing variator during a field conversion of the computer to establish and post a unit volume price, e.g., of a quart or liter of gasoline. For the purpose of permitting advance installation of the gear box 110, it is also designed to selectively provide a 1:1 drive ratio for gallons pricing and cost computation in the conventional manner as described.

The gear box 110 includes variator drive gear 114 having an upwardly projecting hub mounted on a depending end of variator drive center shaft 30. A diametrically extending opening is formed through variator center shaft 30, and a coupling pin 116 is press fit through the opening in shaft 30 and is received within diametrically opposed axially extending slots such as shown at 118 in the hub of variator drive gear 114 to key it for rotation to the variator center shaft 30.

Input shaft 19 of gear box 110 is shown supported for rotation within gear box housing 120 inside its bushing 122 which is in coaxial alignment with the variator center shaft 30. Input shaft 19 has a compound converter drive gear 124 integrally formed on the upper end of shaft 19 in concentric relation to shaft 19. The variator drive gear 114 is shown as having a boss on its lower surface engaging the confronting surface of upper compound gear 124A which serves to support gear 114 for rotation. The compound gear 124 is supported on a thrust washer 126 seated on housing 120 in surrounding relation to input shaft 19. Input shaft 19 is retained against unintended upward axial displacement by a locking ring 128 fitted within a circumferentially extending groove or annulus in shaft 19 adjacent a lower surface of housing 120. The variator drive gear 114 and pin 116 will be understood to be assembled on variator center shaft 30 before housing 120 is installed on the underside of variator base 112. For ease in assembly, a retaining ring 132 is shown fitted within an annulus in the hub of variator drive gear 114 such that the ring 132 is engageable with opposite ends of pin 116.

To establish the desired gear ratios for significantly expanding the price range of conventional fuel pump computers in accordance with this invention, gear box 110 incorporates an axially shiftable converter shaft 134 mounted parallel to variator center shaft 30 with the converter shaft 134 supported for rotation within a bushing 136 fitted inside a retaining sleeve 138 of housing 120. First, second and third driven gears 140, 142 and 144 of change speed gearing 145 are coaxially mounted in stacked relation to one another on shaft 134 and in meshing engagement respectively with first and second compound drive gears 124B, 124A of input shaft 19 and the variator drive gear 114. Thrust washer 146 is interposed between lower gear 140 and the top of sleeve 138, and a pair of thrust washers are shown at 148 and 150 between gears 140, 142 and 142, 144 respectively.

Gear 144 is keyed to shaft 134 by a coupling pin 152 press fit to extend diametrically through shaft 134 to project through a pair of diametrically opposed axially extending slots such as at 154 formed in an upwardly extending hub of gear 144. Coupling pin 152 serves as a pivot pin for pawl 156 received within an axial slot 158 in shaft 134 and is biased in a first angular direction, or counterclockwise direction as viewed in FIG. 2, by spring 160 fitted within a transversely extending chamber 162 formed in converter shaft 134 in communication with its axial slot 158 and engaging a swinging end of pawl 156. By the above described construction, a nose of pawl 156 may be urged by spring 160 into an opening or keyway such as at 164 and 166 formed on the inner diameter wall respectively of gears 140 and 142.

The converter shaft 134 and pawl 156 jointly operate as an interlock to provide a selective driving connection between input shaft 19 and variator drive gear 114 by selectively engaging shaft 134 with gears 140 and 142 upon axial positioning of the converter shaft 134. In its illustrated first operating position, the converter shaft 134 is positioned such that pawl 156 provides a driving connection between shaft 134 and gear 140 by the drive coupling established by gear 140 and the nose of pawl 156 received within keyway 164 of gear 140. In this first operating position of the converter shaft 134, it is to be understood that a 1:1 drive ratio is established for gallons pricing and computation system or possibly quart pricing if the register has been modified as described above. For example, in the illustrated embodiment, gears 124B, 140, 144 and 114 may each be formed with 54 teeth to effect the 1:1 direct drive from input shaft 19 to variator center shaft 30.

In a second operating position of converter shaft 134, pawl 156 is disengaged from gear 140, cammed over washer 148 and is engageably locked within keyway 166 of gear 142 upon raising the axially shiftable shaft 134 to establish a drive connection from gear 142 to shaft 134 so that the nose of pawl 156 registers with keyway 166 of gear 142. In this second operating position of the converter shaft 134, it is to be understood that a 56:53 or 1.0566:1 drive ratio reduction is effected from the input shaft 19 to the variator drive gear 114 for liter pricing upon changeover from a previous setting, e.g., for quarts computation and registration. While a liter is equal to 1.0567 quarts, the 0.0001 difference between the effected gear reduction and that reduction exactly required may be accommodated by adjustment of meter 16 within its available adjustment range.

For securing the gear box group in 1:1 drive ratio in the first operating position of the converter shaft 134 as illustrated in FIG. 2, a locking ring 168 is fitted within an annulus 170 on a depending end of shaft 134 adjacent sleeve 138 to prevent unintended upward displacement of shaft 134 out of its 1:1 drive ratio position. To modify the gear ratios, the locking ring 168 is first removed to permit the conversion to liter pricing. Once converter shaft 134 has been shifted upwardly into its second position in driving engagement with gear 142 for liter pricing, the gear box 110 is effectively protected against tampering and unauthorized changeover since shaft 134 is dimensioned such that its previously exposed lower end is withdrawn entirely into the confines of sleeve 138 of housing 120 with the pawl 156 being captured by washer 148 within keyway 166 and thus permanently retaining the shaft 134 in position.

Accordingly, the computer may be modified by virtue of the above described field convertible quarts/liters gear box or converter for selectively converting a conventional gasoline pump computer from a gallons computation and registration system to either a quart or liter computation and registration system. A unit volume price of a quart or liter of gasoline thus may be established and posted with the variator 20, and thereby substantially expand the maximum available price which may be established by the variator setting. The volume amount of fuel delivered may be registered in quarts/liters with the register volume counters 25 and respectively compute with the variator 20 and register with the register cost counters 38 the cost of fuel delivered in accordance with the unit volume amount of fuel delivered in quarts/liters and the unit volume price of a quart/liter of fuel established by the variator setting. In addition, once the gear box has been converted to liters computation and registration, the gear change is permanently accomplished and the gear box is essentially tamper-proof and does not require resealing.

Figure 5:
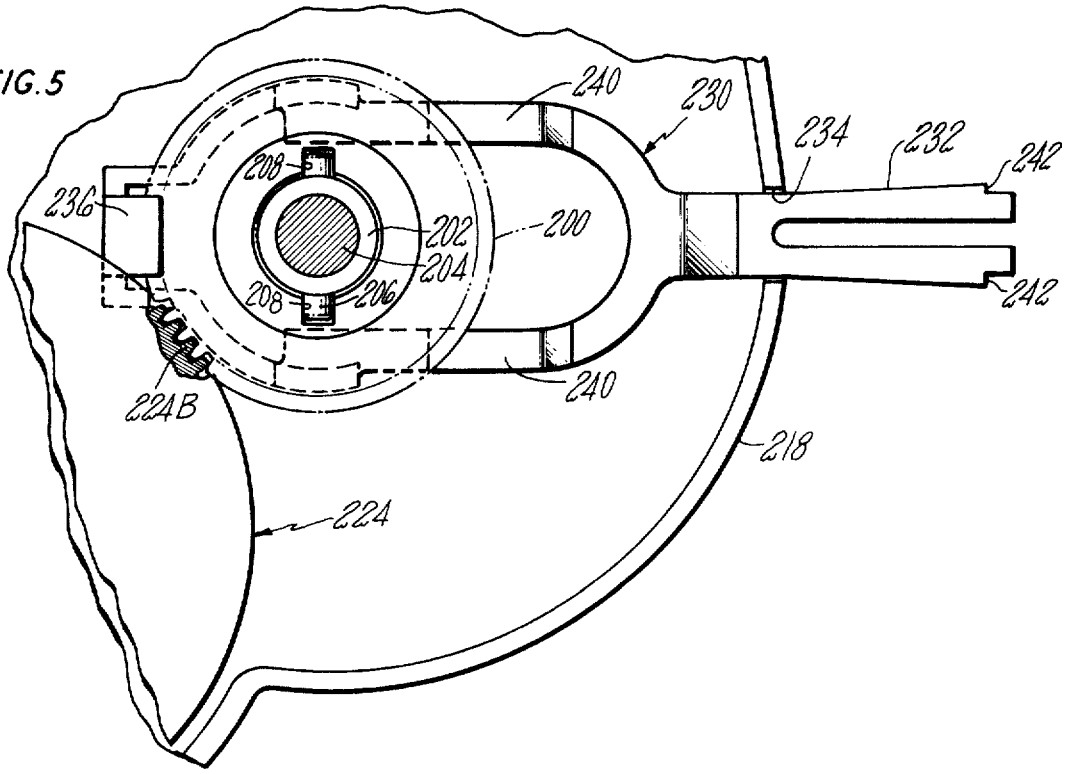
FIG. 5 is a top view, partly broken away and with other parts omitted for clarity, showing certain components of the gear box of FIG. 4.
Figure 4:
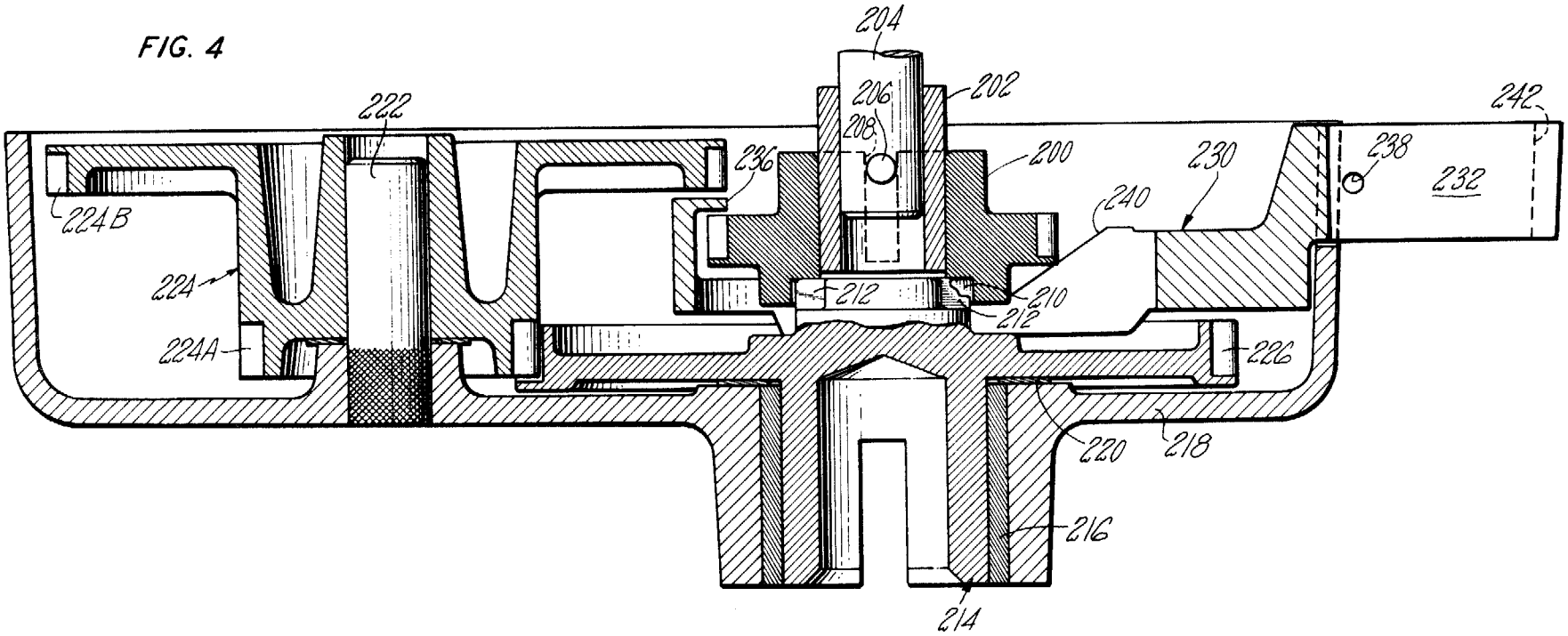
FIG. 4 is an enlarged elevational view, partly broken away and partly in section, of another type auxiliary gear box of this invention for a modified mechanical computer.

Another embodiment of a gasoline pump computer converter constructed in accordance with this invention is shown in FIGS. 4 and 5. The variator converter unit has a variator drive gear 200 supported for rotation by a sleeve 202 fitted on a depending end of variator center shaft 204. A pin 206 is press fit to extend through a diametrical opening in center shaft 204 and through conforming openings in the sleeve 202 and into diametrically opposed axially extending slots 208, 208 formed in the variator drive gear 200 to couple the drive gear 200 for rotation with the variator center shaft 204.

As best seen in FIG. 4, the variator drive gear 200 has a lower boss extending axially downwardly with a pair of diametrically opposed radial openings 210, 210 formed therein for receiving diametrically opposed radially outwardly projecting drive lugs 212, 212 formed on an upper end of input shaft 214 in equiangularly spaced relation from the axially extending slots 210, 210 in the variator drive gear 200. The variator drive gear 200 is thus supported on the lugs 212, 212 for rotation therewith in driving engagement with input shaft 214 which is supported within a bushing 216 of gear box housing 218 and mounted upon a suitable thrust washer 220 in coaxial alignment with variator drive gear 200 and center shaft 204.

From the foregoing description, it will be apparent that a direct 1:1 drive ratio is provided between input shaft 214 and the variator drive gear 200 with the driving connection being established between the drive lugs 212, 212 of the input shaft 214 and the variator drive gear 200.

A compound gear support shaft 222 is mounted in parallel relation to the coaxially arranged input shaft 214 and variator center shaft 204 with the support shaft 222 affixed within gear box housing 218 to support compound gear 224 for rotation. The compound gear 224 has a first or lower gear 224A, in constant meshing engagement with a drive spur gear 226 of input shaft 214, and a second or upper gear 224B. Compound gear 224 simply idles when variator drive gear 200 is in direct 1:1 driving relation to input shaft 214.

To convert the variator from a gallons computation and registration system, e.g., to a liters computation and registration system, a slide 230 is provided and is shown supported on an upper shoulder of the input shaft 214 surrounding its hub. Slide 230 is so designed and dimensioned to shift from its illustrated first operating position to drive the variator drive gear 200 from its illustrated position upwardly into a raised position in meshing engagement with the upper gear 224B of compound gear 224. To effect quick and easy but irreversible field conversion, slide 230 is provided with an operating handle 232 which is shown as having bifurcated parts projecting generally horizontally outwardly through a side wall opening 234 in housing 218 below the variator base. Opposite its handle 232, slide 230 has an upstanding free-end with a reversely turned lip 236 which serves as a stop to prevent any substantial unintended upward movement of the variator drive gear 200 when the slide 230 is in its illustrated first operating position and the converter is in a first setting for gallons computation and registration. The slide 230 is normally retained in its illustrated position by a removable pin, not shown, which is lightly press fit through suitable openings 238 formed in the bifurcated handle parts adjacent the outside wall surface of housing 218.

When it is desired to establish a liters computation and registration system, the pin is removed from opening 238 and slide 230 is moved to the left as viewed in FIG. 4. Such movement causes an inclined camming surface 240 of slide 230 to drivingly engage an underside of the variator drive gear 200 to axially shift it upwardly along its support sleeve 202 as slide 230 and its lip 236 move to the left thereby to raise variator drive gear 200 into meshing engagement with the upper gear 224B of compound gear 224 to establish a driving connection with change speed gearing 224, 226 and to simultaneously move abutment or lip 236 to the left from its illustrated position of FIG. 4 and into a position in non-interfering relation to drive gear 200.

Upon variator drive gear 200 being moved into meshing engagement with the compound gear 224, the handle 232 of slide 230 is then positioned in its entirety within the confines of housing 218 to establish a second operating position of the slide. The sidewall opening 234 in housing 218 and the bifurcated slide handle 232 are relatively dimensioned such that the bifurcated handle parts are increasingly pressed together as the handle moves to the left until the conversion is complete at which time the handle 232 is received within the gear box housing 218 and the bifurcated handle parts provide a spring return as relieved terminal ends on opposite side surfaces of the handle 232 ride over the housing walls surrounding side opening 234 to lock the handle 232 within the gear box housing 218 with locking shoulders 242, 242 of the bifurcated handle parts engaging the inner wall surfaces of the gear box housing 218 and positively preventing the converter from being reset to its original gallons setting once the changeover to a different computation such as liters has been made.

Depending on the drive ratio established between the input shaft 214 and variator drive gear 200 when it is in its raised position, the converter may be employed to provide a changeover from Imperial gallons, e.g., to liters, or from standard United States gallons to liters or from standard United States gallons to quarts through the change speed gearing 224, 226, 200. To provide a conversion from Imperial gallons to liters, a drive ratio increase of 1:4.545 is established from the input shaft 214 to the variator drive gear 200 through the gear box, for example, by providing gears 226, 224A, 224B and 200 with 50, 16, 32 and 22 teeth, respectively. With respect to effecting a conversion from United States gallons to liters, the gear box drive ratio speed up is 1:3.786, for example, by providing gears 226, 224A, 224B and 200 with 53, 21, 36 and 24 teeth, respectively. Likewise, for converting from United States gallons to quarts, the gear box drive ratio increase of 1:4 may be established by providing gears 226, 224A, 224B and 200 with 48, 16, 32 and 24 teeth, respectively. If desired, a conversion unit of the type described may also be provided for effecting a conversion from quarts to liters or from liters to quarts by the provision of a suitable gear box group.

The converter of this invention will be seen to provide facile field conversion of existing conventional computers, as well as to provide for prior installation of the converter unit in a new gasoline pump computer. Once a conversion has been made, it will be seen to be permanent; no resealing of the variator is normally required.

As will be apparent to persons skilled in the art, various modifications, adaptations and variations of the foregoing specific disclosures can be made without departing from the teachings of this invention.

I claim:

1. For use with a mechanical fuel pump computer having a variator and a register wherein the variator has an input shaft normally driven by a fuel meter in accordance with the volume of fuel delivered and is settable to establish a selected unit volume fuel price and wherein the register has a resettable volume counter drivingly connected to the meter via the variator to reflect total volume of each fuel delivery and a resettable cost counter connected to be driven by the meter via the variator in accordance with its setting to provide a price readout of the total cost of each fuel delivery, a converter usable for expanding the price range of the computer and for setting the computer to compute and register total volume and cost of each fuel delivery based on a price for a first unit volume and alternatively for another unit of reduced volume, the converter comprising a converter housing attachable to an underside of the variator, a meter driven rotary input and a rotary output, the rotary output including a variator drive gear, a selectively settable drive connection between the rotary input and the variator drive gear for driving the rotary output at a first drive ratio setting from the rotary input to the variator drive gear for computation and registration of fuel deliveries in preselected units of volume and alternatively at a second drive ratio setting for computation and registration of fuel deliveries in units of different volume from that established in said first setting, and an interlock movable from a first operating position to a second operating position to change the drive ratio from said first setting to said second setting, the interlock extending outside the housing in said first operating position, and means inside the housing engageable with the interlock in said second operating position to positively prevent return movement thereof to said first operating position.

2. The converter of claim 1 wherein the interlock in its second operating position is permanently confined within the converter housing and is positively locked therein against return movement from said second operating position to said first operating position.

3. The converter of claim 1 wherein the rotary input and variator drive gear are supported for rotation in coaxial alignment, and wherein the selectively settable drive connection includes intermediate change speed gearing between the rotary input and variator drive gear for establishing said second drive ratio setting.

4. The converter of claim 3 wherein first and second compound drive gears are fixed to the rotary input, wherein the interlock includes an axially shiftable converter shaft mounted on the housing, wherein the intermediate change speed gearing includes first, second and third driven gears coaxially supported for rotation on the converter shaft in meshing engagement respectively with the first and second compound drive gears and the variator drive gear, wherein the interlock further includes a pawl pivotally supported by the converter shaft and biased in a first angular direction for driving engagement selectively with the first and second driven gears, and wherein said means inside the housing comprises the first and second driven gears engageable with the pawl for establishing the first and second drive ratio settings in accordance with the axial setting of the converter shaft in said first and second operating positions.

5. The converter of claim 4 wherein the pawl is disengageable from said first driven gear upon moving the converter shaft in a first axial direction from said first operating position into said second operating position, the pawl being engageable with said second driven gear upon movement of the converter shaft into said second operating position, and wherein a spring biases the pawl in said first angular direction toward engagement with the driven gears such that the pawl positively prevents reverse movement of the converter shaft in a direction opposite said first axial direction of movement.

6. The converter of claim 4 wherein the axially shiftable converter shaft is received in its entirety within the confines of the converter housing in its said second operating position.

7. The converter of claim 3 wherein the interlock comprises a slide received in the housing and having a camming surface engageable with the variator drive gear, the slide having an operating handle which in said first operating position of the slide extends through a wall opening in the housing with at least a part of the handle exposed outside the housing, and wherein the slide is movable by its operating handle to said second operating position to cause the camming surface of the slide to engage and move the variator drive gear into meshing engagement with the intermediate change speed gearing to establish said second drive ratio setting.

8. The converter of claim 7 wherein the operating handle of the slide upon movement thereof into its said second operating position is permanently retained in its entirety with the confines of the housing, thereby to prevent return movement of the slide to its said first operating position.

9. The converter of claim 7 wherein the slide operating handle has bifurcated parts with relieved terminal ends providing locking shoulders, wherein the housing wall opening is so dimensioned relative to the bifurcated handle parts that the housing causes the handle parts to be pressed toward one another during slide movement through the housing wall opening, wherein the bifurcated handle provides a spring return of its handle parts once the relieved terminal ends pass through the housing wall opening and establish said second operating position of the slide, and wherein said means inside the housing comprises an interior surface of the housing wall adjacent its opening to positively lock the slide within the housing against withdrawal to make said second drive ratio setting irreversible without disassembly of the housing from the variator.

10. The converter of claim 7 wherein the slide has an abutment opposite its handle with the abutment normally positioned between the variator drive gear and the intermediate speed change gearing when the slide is in its said first operating position, whereby the abutment interferes with inadvertent movement of the variator drive gear toward the intermediate speed change gearing when the first drive ratio setting is established.

11. The converter of claim 10 wherein the slide abutment is moved into non-interfering relation to the variator drive gear upon movement of the slide from its said first operating position to said second operating position.

12. The converter of claim 1 wherein said first drive ratio setting establishes a 1:1 drive ratio from the rotary input to the variator drive gear for gallons computation and registration of fuel deliveries, and wherein said second drive ratio setting establishes computation and registration of fuel deliveries in units of relatively reduced volume with respect to said gallons units of volume.

* * * * *